US009033334B2

(12) United States Patent
Yano

(10) Patent No.: US 9,033,334 B2
(45) Date of Patent: May 19, 2015

(54) SHEET FEEDING APPARATUS AND IMAGE FORMING APPARATUS

(71) Applicant: CANON KABUSHIKI KAISHA, Tokyo (JP)

(72) Inventor: Takashi Yano, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/055,065

(22) Filed: Oct. 16, 2013

(65) Prior Publication Data

US 2014/0159299 A1 Jun. 12, 2014

(30) Foreign Application Priority Data

Dec. 7, 2012 (JP) ..... 2012-268237

(51) Int. Cl.
*B65H 3/52* (2006.01)
*B65H 1/12* (2006.01)

(52) U.S. Cl.
CPC ..... *B65H 3/5215* (2013.01); *B65H 3/5261* (2013.01); *B65H 2404/1345* (2013.01); *B65H 1/12* (2013.01); *B65H 2402/543* (2013.01); *B65H 2403/732* (2013.01); *B65H 2404/1341* (2013.01)

(58) Field of Classification Search
USPC ..... 271/121, 122, 123, 124, 125
See application file for complete search history.

(56) References Cited

U.S. PATENT DOCUMENTS

| | | | | |
|---|---|---|---|---|
| 5,738,452 | A * | 4/1998 | Uchida | 400/624 |
| 6,260,840 | B1 | 7/2001 | Suga et al. | |
| 6,382,622 | B1 | 5/2002 | Takada et al. | |
| 6,467,767 | B2 | 10/2002 | Yano | |
| 6,988,727 | B2 | 1/2006 | Yano | |
| 7,384,034 | B2 * | 6/2008 | Nagura et al. | 271/125 |
| 7,427,060 | B2 * | 9/2008 | Taniyama | 271/122 |
| 7,708,267 | B2 | 5/2010 | Shigeno | |
| 8,215,637 | B2 | 7/2012 | Yano | |
| 8,317,193 | B2 | 11/2012 | Yano | |
| 2006/0237895 | A1 * | 10/2006 | Nishikata et al. | 271/121 |
| 2009/0152801 | A1 | 6/2009 | Shigeno | |

* cited by examiner

*Primary Examiner* — Ernesto Suarez
(74) *Attorney, Agent, or Firm* — Fitzpatrick, Cella, Harper & Scinto

(57) ABSTRACT

A sheet feeding apparatus comprising: a storage portion; a feeding portion; and a separation portion, wherein the separation portion includes: a separation member which rotates around a rotation center shaft to separate one by one the sheets; an urging portion which applies a force to the rotation center shaft toward the feeding portion; a torque imparting portion to impart a torque to the separation member in a direction opposite to a direction which the separation member rotates; a first and a second support member which supports one end and other end of the rotation center shaft while regulating rotation of the rotation center shaft; and a deviation restraining portion which restrains deviation of a reaction force of the torque applied to the separation member by the torque imparting portion and acting on the first support member and the second support member.

9 Claims, 6 Drawing Sheets

SHEET FEEDING APPARATUS AND IMAGE FORMING APPARATUS

BACKGROUND OF THE INVENTION

1. Field of the Invention

The present invention relates to a sheet feeding apparatus and an image forming apparatus including the sheet feeding apparatus.

2. Description of the Related Art

In U.S. Patent Application Publication No. 2009/0152801 A1, a torque limiter is provided on one side of a separation roller shaft, and a D-like cut portion is formed on one end of a torque limiter shaft. The D-like cut portion formed on one end of the torque limiter shaft is supported by the separation roller, and the other end of the torque limiter shaft is supported by a bearing. In a case of this configuration, when the separation roller and a feeding roller rotate, a torque is applied to the D-like cut portion due to the function of the torque limiter and a twisting occurs in the separation roller. Thus, a pressure by which the separation roller is pressed against the feeding roller may become non-uniform in an axial direction of the separation roller. This phenomenon has influence on accuracy of a sheet conveyance.

In addition, a configuration of forming the D-like cut portion on both ends of the torque limiter shaft may be also considered. In such case, since a separation torque is applied to both ends of the shaft, it may theoretically be an effective configuration in that the influence of the separation torque is equally distributed in the right and left of the separation roller.

However, it is extremely difficult to assure a stable effect in an actual apparatus. The reason is that the assurance of a dimensional relation capable of equally distributing the separation torque in the right and left is practically unachievable due to variation in machining accuracy. Examples of factors causing the variation in machining accuracy include dimensional differences between the D-like cut portions provided on both ends of the separation roller shaft (corresponding to the torque limiter shaft described above), dimensional differences between shapes of holders engaging with the D-like cut portions, width dimensions of a bearing for supporting the separation roller shaft, width dimensions of a guide portion for slidingly regulating the bearing, and rigidity of each part or shapes. There are many factors that cause the difference between the right and the left, and thus it is not realistic to perfectly manage these all. Therefore, the above problems are not solved only by providing the D-like cut portion on both ends of the separation roller shaft.

SUMMARY OF THE INVENTION

According to the invention, it is desirable to provide a sheet feeding apparatus that restrains a non-uniform phenomenon of an urging force that the separation portion applies a force to the feeding portion, in a direction of a rotation center shaft.

A sheet feeding apparatus according to an aspect of the invention includes: a storage portion that stores a sheet; a feeding portion which feeds the sheet stored in the storage portion; and a separation portion which separates one by one the sheets fed by the feeding portion. Here, the separation portion includes: a separation member which rotates around a rotation center shaft to separate one by one the sheets; an urging portion which applies a force to the rotation center shaft toward the feeding portion; a torque imparting portion which is disposed between the rotation center shaft and the separation member to impart a torque to the separation member in a direction opposite to a direction in which the separation member rotates by following a sheet to be conveyed; a first support member which supports one end of the rotation center shaft while regulating rotation of the rotation center shaft; a second support member which supports the other end of the rotation center shaft while regulating rotation of the rotation center shaft; and a deviation restraining portion which restrains deviation of a reaction force of the torque applied to the separation member by the torque imparting portion and acting on the first support member and the second support member.

Further features of the present invention will become apparent from the following description of exemplary embodiments with reference to the attached drawings.

DESCRIPTION OF THE EMBODIMENTS

First Embodiment

Figure 1A:
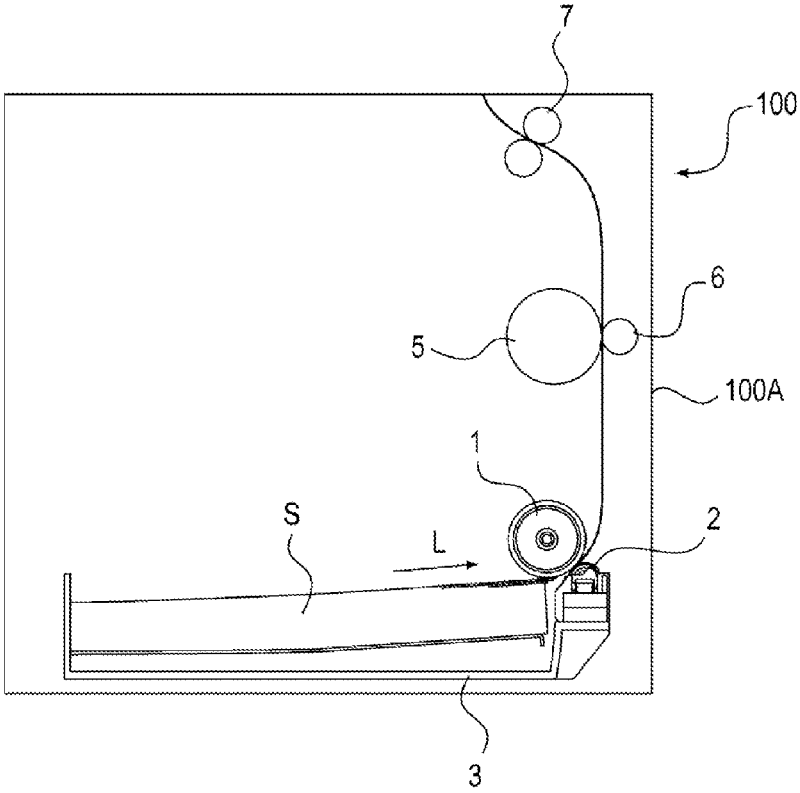
FIG. 1A is a cross-sectional view of an image forming apparatus.

FIG. 1A is a cross-sectional view of an image forming apparatus 100. The image forming apparatus 100 includes an apparatus body 100A as an "image forming apparatus body". A photosensitive drum 5, a charging roller, an exposure device, a developing device, a transfer roller 6 (image forming portion) are disposed inside the apparatus body 100A. The surface of the photosensitive drum is uniformly charged by the charging roller, an electrostatic image is formed on the surface of the photosensitive drum by a laser beam of the exposure device, and the electrostatic image is developed with a developer by the developing device.

Moreover, a cassette 3 is disposed inside the apparatus body 100A to store a sheet S, as a "storage portion". On the upper side of the cassette 3, a feeding roller 1 as a "feeding portion" and a separation roller 2 as a "separation portion" are disposed. The feeding roller 1 feeds the sheet S stored in the cassette 3, and the separation roller 2 separates one by one the sheets to be fed by the feeding roller 1. The sheets S inside the cassette 3 are separated one by one by the feeding roller 1 and the separation roller 2, and the separated sheet is fed to a conveyance path. Then, the sheet S is conveyed to a nip between the photosensitive drum 5 and the transfer roller 6, and a developing image is transferred onto the sheet S. After then, the sheet S is conveyed to a fixing device 7 (image forming portion), and then the developing image is fixed on the sheet S.

Figure 1B:
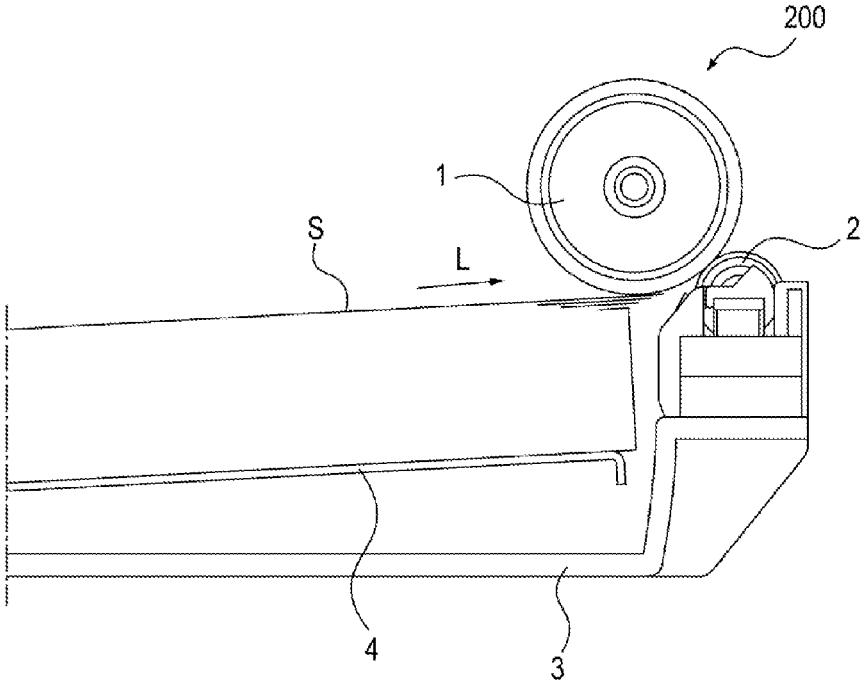
FIG. 1B is a cross-sectional view illustrating a periphery of a separation roller of a feeding apparatus.

FIG. 1B is a cross-sectional view illustrating a periphery of the separation roller 2 of a feeding apparatus 200. The feeding apparatus 200 as a "sheet feeding apparatus" includes the cassette 3. The cassette 3 includes a sheet supporting plate 4 that freely swings around an axis which is upstream of a sheet feeding direction L. A pressing spring (not illustrated) applies a force to the sheet supporting plate 4 in the upward direction. The sheet S is placed on the sheet supporting plate 4. On the sheet supporting plate 4, when a bundle of the sheets S is thick, a downstream portion of the sheet feeding direction L of the sheet supporting plate 4 goes down to a lower position, and when the bundle of the sheets S is thin, the downstream portion of the sheet feeding direction L of the sheet supporting plate 4 rises to a higher position. The uppermost sheet S of the bundle of the sheets S is abutted on the feeding roller 1 to press the feeding roller 1. The separation nip, at which the feeding roller 1 and the separation roller 2 are abutted on each other by being pressed against each other, is positioned at the downstream of the sheet feeding direction L farther than a position where the feeding roller 1 and the sheet S are abutted on each other.

Figure 2A:
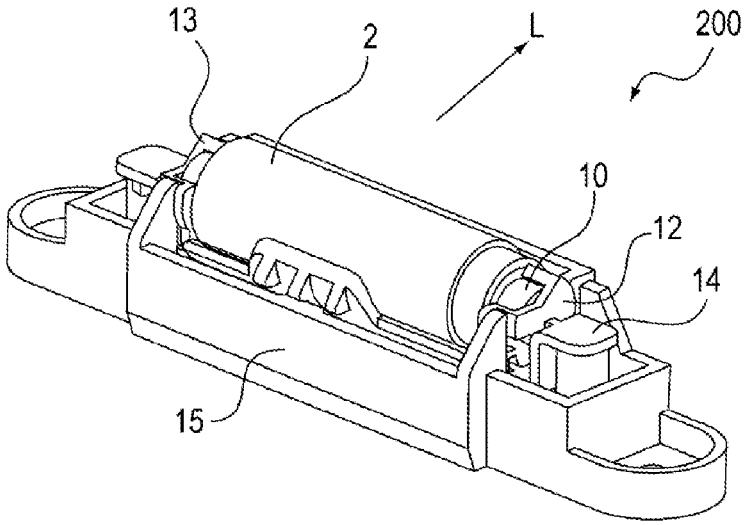
FIG. 2A is a perspective view and an exploded view of the feeding apparatus in which the separation roller is slidingly pressed against a feeding roller.
Figure 2B:
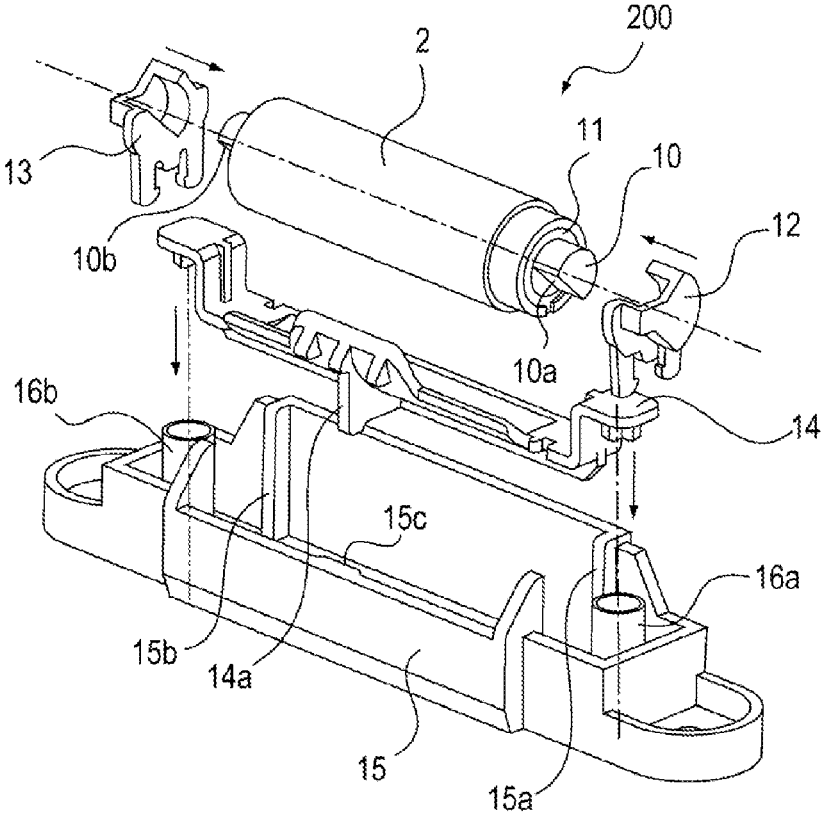
FIG. 2B is an exploded perspective view of FIG. 2A.

FIG. 2A is a perspective view of the feeding apparatus 200 in which the separation roller 2 is slidingly pressed against the feeding roller 1. FIG. 2B is an exploded perspective view of FIG. 2A. As illustrated in FIGS. 2A and 2B, the feeding apparatus 200 includes a separation roller shaft 10 as a "rotation center shaft", the separation roller 2 as a "separation member", pressing springs 16*a* and 16*b* as a "urging portion", and a torque limiter 11 as a "torque imparting portion". The torque limiter 11 is provided as an end side on the separation roller shaft 10. These components are parts of the separation portion. In addition, the feeding apparatus 200 includes a first support arm (separation portion) 12 as a "first support member", a second support arm (separation portion) 13 as a "second support member", and a link member 14 as a "deviation restraining portion" (separation portion).

The separation roller 2 is rotatably supported on the separation roller shaft 10 and rotates around the separation roller shaft 10 to separate one by one the sheets. The pressing springs 16*a* and 16*b* apply a force to the separation roller shaft 10 toward the feeding roller 1. The torque limiter 11 is disposed between the separation roller shaft 10 and the separation roller 2 so as to connect them to each other, and imparts a torque in a direction opposite to a rotation direction driven by the separation roller 2. The first support arm 12 supports one end (a D-like cut portion 10*a*) of the separation roller shaft 10 to regulate rotation of the separation roller shaft 10. The second support arm 13 supports the other end (a D-like cut portion 10*b*) of the separation roller shaft 10 to regulate rotation of the separation roller shaft 10. The link member 14 restrains the deviation of the torque from generating in a direction of the separation roller shaft 10 from one end to the other end of the separation roller 2. Furthermore, the D-like cut portions 10*a* and 10*b* formed on both ends of the separation roller shaft 10 are non-rotatably fixed to the first support arm 12 and the second support arm 13, respectively.

The first support arm 12 and the second support arm 13 are connected to each other by the link member 14, and a connection portion becomes a joint structure with a degree of freedom. In addition, shapes of spring seats are provided on both ends of the link member 14, and the pressing springs 16*a* and 16*b* are incorporated between the link member 14 and a support body 15 included in the feeding apparatus 200. Through these actions, the separation roller 2 is pressed against the feeding roller 1 to be abutted on each other. Setting pressures of two pressing springs 16*a* and 16*b* are set such that pressure distribution of the nip of the separation roller 2 becomes equal in consideration of a weighted center of a target component to be pressed.

A pressing operation of the separation roller 2 is slidingly regulated by a configuration described below. Furthermore, for the purpose of clearly describing the effects of the invention, the description of a portion, which is not directly related to the effects of the invention, for example, a shape to regulate an attachment manner of a component will not be provided.

Figure 3:
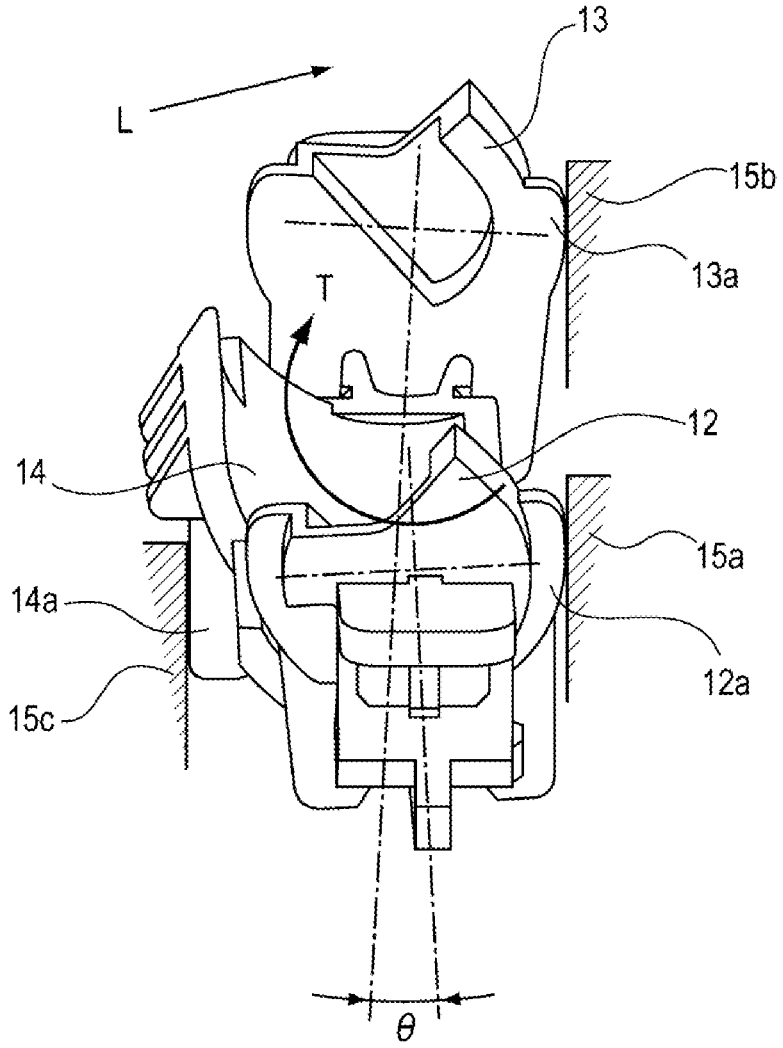
FIG. 3 is an explanatory diagram illustrating an operational state of a first support arm, a second support arm, and a link member during a feeding operation.

FIG. 3 is an explanatory diagram illustrating an operational state of the first support arm 12, the second support arm 13, and the link member 14 during the feeding operation. The first support arm 12 includes a first sliding surface portion 12*a* which is formed on the downstream of the sheet feeding direction L, as a "first downstream portion". The second support arm 13 includes a second sliding surface portion 13*a* which is formed on the downstream of the sheet feeding direction L, as a "second downstream portion". The first sliding surface portion 12*a* and the second sliding surface portion 13*a* are formed so as to protrude in the form of a substantially concentric circle with the separation roller shaft 10.

The feeding apparatus 200 includes the link member 14 as a "connection member" (deviation restraining portion) and the support body 15 (deviation restraining portion). The link member 14 connects the first support arm 12 and the second support arm 13 to each other. The link member 14 includes a third sliding surface portion 14*a* which is formed at an upstream of the sheet feeding direction L, as an "upstream portion". The support body 15 supports the first support arm 12 and the second support arm 13 through the pressing springs 16*a* and 16*b* and the link member 14.

The support body 15 includes sliding guide surfaces such as a first guide surface 15*a*, a second guide surface 15*b*, and a third guide surface 15C. The first guide surface 15*a* and the second guide surface 15*b* are formed at two places on the downstream with respect to the nip in which the separation roller 2 is abutted on the feeding roller 1, and the third guide surface 15*c* is formed at one place on the upstream with respect to the nip. Moreover, the first guide surface 15*a* is partitioned in the support body 15 to face the first sliding surface portion 12*a* and to lock the first support arm 12 so as not to move in the sheet feeding direction L (sheet conveying direction). The second guide surface 15*b* is partitioned in the support body 15 to face the second sliding surface portion 13*a* and to lock the second support arm 13 so as not to move in the sheet feeding direction L (sheet conveying direction). The third guide surface 15*c* is partitioned in the support body 15 to face the third sliding surface portion 14*a*.

When the separation roller 2 rotates, it is assumed that the deviation of the reaction force of the torque, which is applied to the separation roller 2 by the torque limiter 11 acting on the first support arm 12 and the second support arm 13 when the second sliding surface portion 13*a* abuts on the second guide surface 15*b* while the first sliding surface portion 12*a* abuts on the first guide surface 15*a*, is generated. The deviation, as will be described below, is restrained by the balance between a pressing force by which the first sliding surface portion 12*a* is pushed against the first guide surface 15*a* and a pressing force by which the second sliding surface portion 13*a* is pushed against the second guide surface 15*b*, when the third sliding surface portion 14*a* abuts on the third guide surface 15*c*. In order to restrain the deviation of an abutting force of the first sliding surface portion 12*a* on the first guide surface 15*a* and an abutting force of the second sliding surface portion 13*a* on the second guide surface 15*b*, the reaction force of the torque applied to the separation roller 2 by the torque limiter 11 is distributed to the first support arm 12 and the second support arm 13 using an abutting portion between the third sliding surface portion 14*a* and the third guide surface 15*c* as a fulcrum.

In addition, the third sliding surface portion 14*a* is also provided near the center of the link member 14 which connects the first support arm 12 and the second support arm 13 to each other, and the third sliding surface portion 14*a* faces the third guide surface 15*c* of the support body 15. It is assumed that a first abutting position X1 is a position where the first sliding surface portion 12*a* abuts on the first guide surface 15*a*, a second abutting position X2 is a position where the second sliding surface portion 13*a* abuts on the second guide surface 15*b*, and a third abutting position X3 is a position where the third sliding surface portion 14*a* abuts on the third guide surface 15*c*. In this case, the third abutting position X3 is disposed between the first abutting position X1 and the second abutting position X2 in an axial direction of the separation roller shaft 10.

During the feeding operation, since a separation torque T acts on the separation roller shaft 10, these three guide surfaces 15*a*, 15*b*, and 15*c* and the sliding surface portions 12*a*, 13*a*, and 14*a* are abutted on each other, thus being stably positioned by a three-point supporting. In the actual feeding apparatus 200, the relative phase difference θ between the first support arm 12 and the second support arm 13, that is, the phase difference between rotation locking portions of the separation roller shaft 10 necessarily occurs depending on the variation of the dimensional accuracy in peripheral components of the separation portion, and the value has a certain degree of variation between the devices.

Figure 4A:
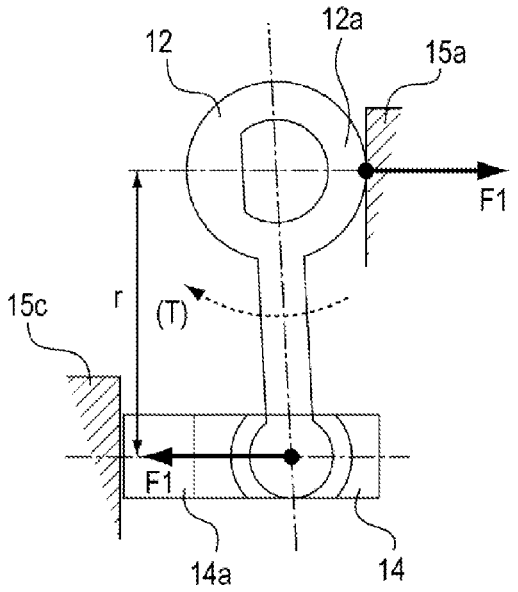
FIGS. 4A to 4C are diagrams illustrating states where a twist force acting on the first support arm and the second support arm from a separation roller shaft is stably applied inside a separation mechanism.
Figure 4B:
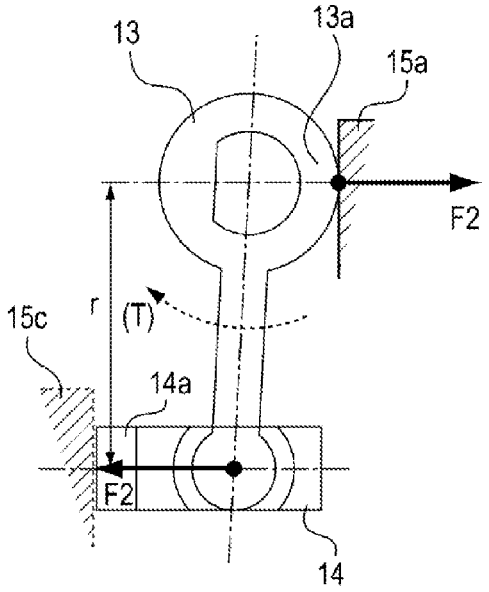
Figure 4C:
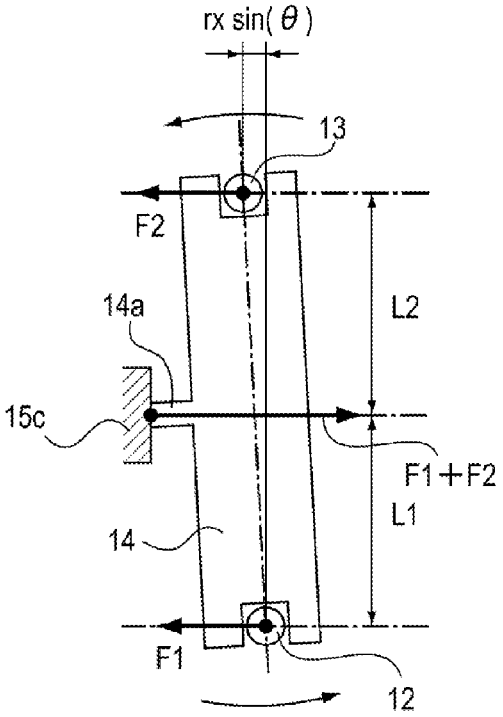

Next, with the above configuration, a mechanism capable of resolving the influence of the separation torque with respect to the nip pressure distribution of the separation roller 2 will be described. FIGS. 4A to 4C are diagrams illustrating the state of the separation mechanism illustrated in FIG. 3 by a simple dynamic model. Two types of dynamic forces, for example an influence of a twist force caused by the separation torque T acting on the separation roller shaft 10 and a force that causes the separation roller 2 to be pulled to the sheet feeding direction L by the sheet to be conveyed. Since the latter of two forces has no influence on the balance of the nip pressure of the separation roller 2, the description thereof will not be provided in FIGS. 4A, 4B, and 4C, and the former will be focused to describe based on a balance relation of the force.

FIG. 4A is a diagram illustrating a state where the twist force acting on the first support arm 12 and the second support arm 13 from the separation roller shaft 10 is stably applied inside the separation mechanism, from a lateral direction. The force for twisting the first support arm 12 and the second support arm 13 is received by the joint portion formed with the first support arm 12 or the second support arm 13 and the link member 14. The reaction forces thereof act on the abutting portion between the sliding surface portion 12*a* of the first support arm 12 and the first guide surface 15*a* and the abutting portion between the sliding surface portion 13*a* of the second support arm 13 and the second guide surface 15*b* (law of action and reaction), respectively. The forces of this time are defined as forces F1 and F2, respectively.

At this time, the relation of the forces acting on the link member 14 is illustrated in FIG. 4B. The link member 14 has a balance structure (balancing toy structure) using the sliding surface portion 14*a*, which abuts on the third guide surface 15*c*, as a fulcrum, and can be freely inclined using a distal end of the sliding surface portion 14*a* as a fulcrum. Then, the link member 14 is stabilized at a position where the force F1 applied from the first support arm 12 and the force F2 applied from the second support arm 13 are balanced, that is, at a posture satisfying the relation of "F1×L1=F2×L2".

The balance relation of the forces is maintained regardless of a relative phase difference θ between the first support arm 12 and the second support arm 13. At this time, when a distance relation between the fulcrum of the balance structure and a force point is "L1=L2", a load relation becomes "F1=F2", and a contacting pressure of the first support arm 12 to the first guide surface 15*a* and a contacting pressure of the second support arm 13 to the second guide surface 15*b* can be equivalent to each other. The relation between the separation torque T acting on the separation roller shaft and the forces F1 and F2 is expressed as the formula of "F1+F2=T/r". Here, the distance "r" is obtained by approximating the distance between the joint portion formed with the link member 14 and the first support arm 12 or the second support arm 13, and the center of the separation roller shaft 10.

Furthermore, as described above, the relative phase difference θ between the first support arm 12 and the second support arm 13 has no influence on the balance relation of the forces in the separation mechanism. The link member 14 swings using the abutting portion between the third sliding surface portion 14*a* and the third guide surface 15*c* as a fulcrum and is balanced at the position which satisfies the load relation of "F1×L1=F2×L2". Thus, even in the case where the relative phase difference θ is changed depending on the variation of the separation torque during the operation by the difference in component rigidity between the first support arm 12 and the second support arm 13, the relation property between the forces F1 and F2 is stably maintained in a dynamic manner.

In the above embodiment, the twist force due to the separation torque is automatically adjusted so as to be equal in right and left. Therefore, the relative relation between the contacting pressure between the sliding surface portion 12*a* of the first support arm 12 and the first guide surface 15*a* and the contacting pressure between the sliding surface portion 13*a* of the second support arm 13 and the second guide surface 15*b* typically remains in an equal pressure though the feeding operation. As a result, the difference in sliding friction resistance of both sliding surface portions does not occur, and the uniform pressure distribution at the separation nip is achieved.

Second Embodiment

The first embodiment describes the example of performing an additional adjustment by the link member 14, but a second embodiment will describe an application example of the invention different from the first embodiment. Further, in a schematic configuration of a sheet feeding apparatus according to the second embodiment, the same components as those in the first embodiment are incorporated by the description of the first embodiment with the same reference numerals and will not be described.

Figure 5A:
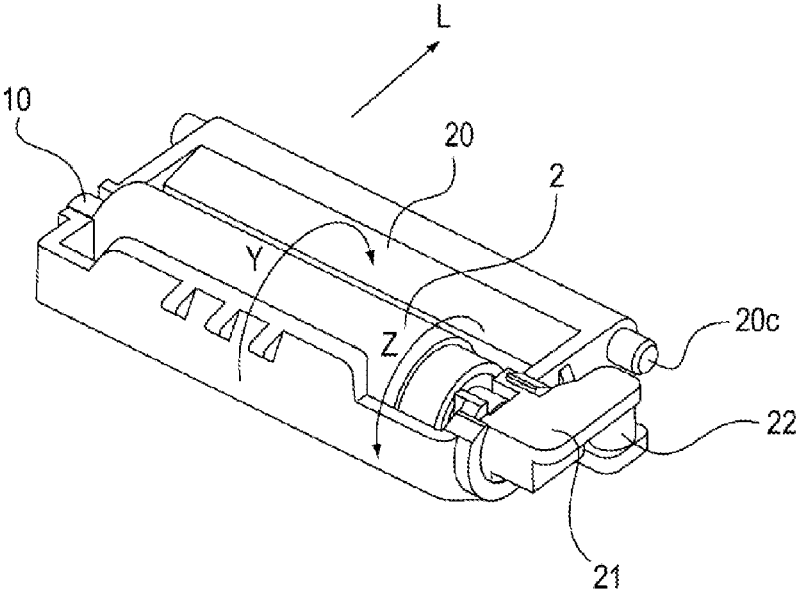
FIGS. 5A and 5B are perspective views and exploded views of a feeding apparatus according to a second embodiment.
Figure 5B:
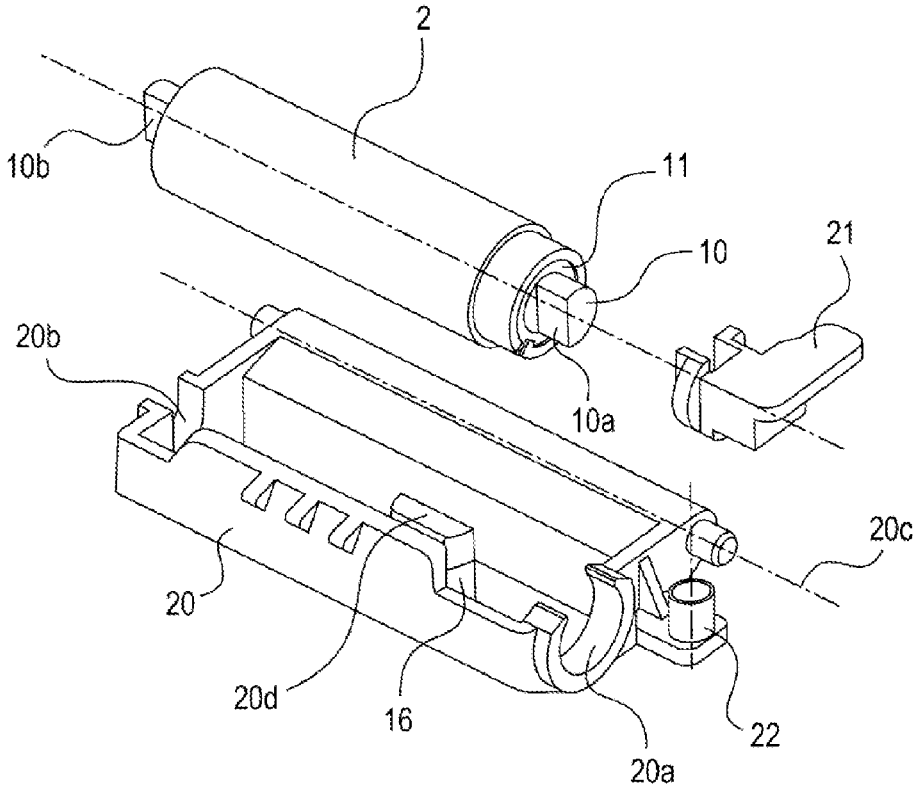

A peripheral configuration of the separation roller 2 according to the present embodiment is illustrated in FIGS. 5A and 5B. A holder 20 as a "first support member" that supports the separation roller 2 is supported on an apparatus body 100A and swings around a swing shaft 20*c* as a "width direction shaft" substantially parallel with the separation roller shaft 10. The D-like cut portions 10*a* and 10*b* are provided at both ends of the separation roller shaft 10, and the D-like cut portion 10*b* provided at one end is directly engaged with a locking portion 20*b* of the holder 20 so as not to rotate (hereinafter, defined as a "first shaft end").

A pressurization lever (lever) 21 as a "second support member" is fixed to the D-like cut portion 10*a* provided at the other end of the separation roller shaft 10. The pressurization lever 21 is axially supported on a supporting hole portion 20*a* of the holder 20 so as to be capable of rotating around the separation roller shaft 10 (hereinafter, defined as a "second shaft end").

In addition, a pressurization spring 22 is incorporated between the pressurization lever 21 and the holder 20 to apply a force to the separation roller shaft 10 so as to rotate in the direction opposite to the sheet feeding direction L. The pressurization spring 22 as an "addition portion" as the "deviation restraining portion" (separation portion) adds a rotation force of a reverse direction relative to the rotation direction of the separation roller 2 to at least one end (D-like cut portion 10*a*) of the separation roller shaft 10 through the pressurization lever 21. Furthermore, a pressing spring 16 is incorporated between a protrusion portion 20*d* of the holder 20 and the separation roller 2, the holder 20 is pressurized by the action of the pressing spring 16, and the separation roller 2 abuts on the feeding roller 1 by pressing the feeding roller 1.

Next, the relation of the first shaft end and the second shaft end will be described. As described above, the separation roller shaft 10 is not rotated by engaging the D-like cut portion 10*b* of the separation roller shaft and the locking portion 20*b* of the holder 20 at the first shaft end. On the contrary, since the pressurization spring 22 is incorporated into the pressurization lever 21 provided on the second shaft end, an urging torque is imparted to the separation roller shaft 10 depending on an urging force of the pressurization spring 22, in the direction opposite to the sheet feeding direction L.

An operation of a sheet feeding apparatus 300 will be described. When the sheet is conveyed to the sheet feeding direction L, the separation roller 2 rotates in a direction of an arrow Y. On the contrary, the torque limiter 11 applies the torque to a direction of an arrow Z. At this time, the pressurization spring 22 applies a force to the lever 21 in the direction of the arrow Z.

In the sheet feeding apparatus 300 according to the present embodiment, a spring pressure of the pressurization spring 22 is set such that a locking torque corresponding to an approximate one-half of the separation torque, which is generated by the torque limiter 11, acts on the separation roller shaft 10 due to the action of the pressurization spring 22. Thus, for example, even when the relative phase difference or the dimensional difference exists in the D-like cut portions 10*a* and 10*b* provided on both ends of the separation roller shaft 10, the D-like cut portion on one end may be assured by a locking torque corresponding to one-half of the separation torque. Therefore, in the related art that is configured to be capable of absorbing the influence, all of the separation torques act on one side.

In a state where the separation torque is not applied, for example, during a standby of the apparatus, the spring force of the pressurization spring 22 does not act for the purpose of the swing of the holder 20. Accordingly, the pressure distribution is uniform without having an influence on the pressure distribution of the nip of the separation roller 2. The separation torque acts on the separation roller shaft 10 by a start of the feeding operation, the twist force acts from the separation roller shaft 10 to the holder 20. At this time, since approximate one-half of the separation torque is applied to the second shaft end due to the action of the pressurization spring 22, the remaining one-half of the separation torque acts on the locking portion 20*b* of the first shaft end. Since the separation torque is locked to the right and left of the holder 20 by half, the degree to which the twist force due to the separation torque affects the pressing force of the separation roller 2 is also equal in the right and left, and thus the pressure distribution balance of the nip of the separation roller 2 is maintained.

Third Embodiment

Figure 6A:
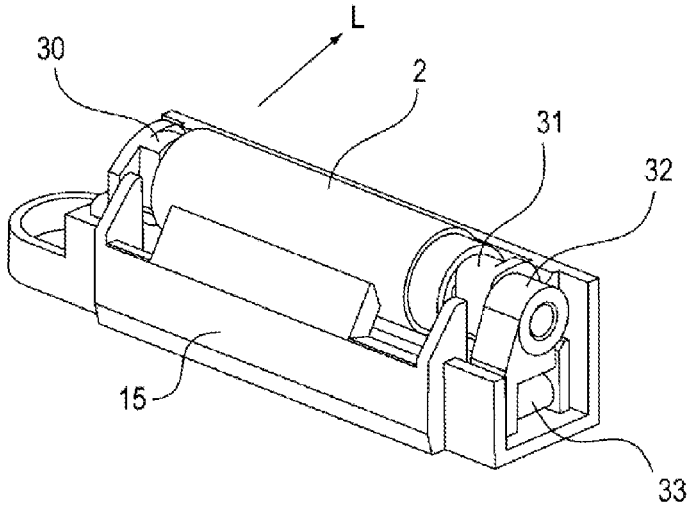
FIGS. 6A and 6B are perspective views and exploded views of a feeding apparatus according to a third embodiment.
Figure 6B:
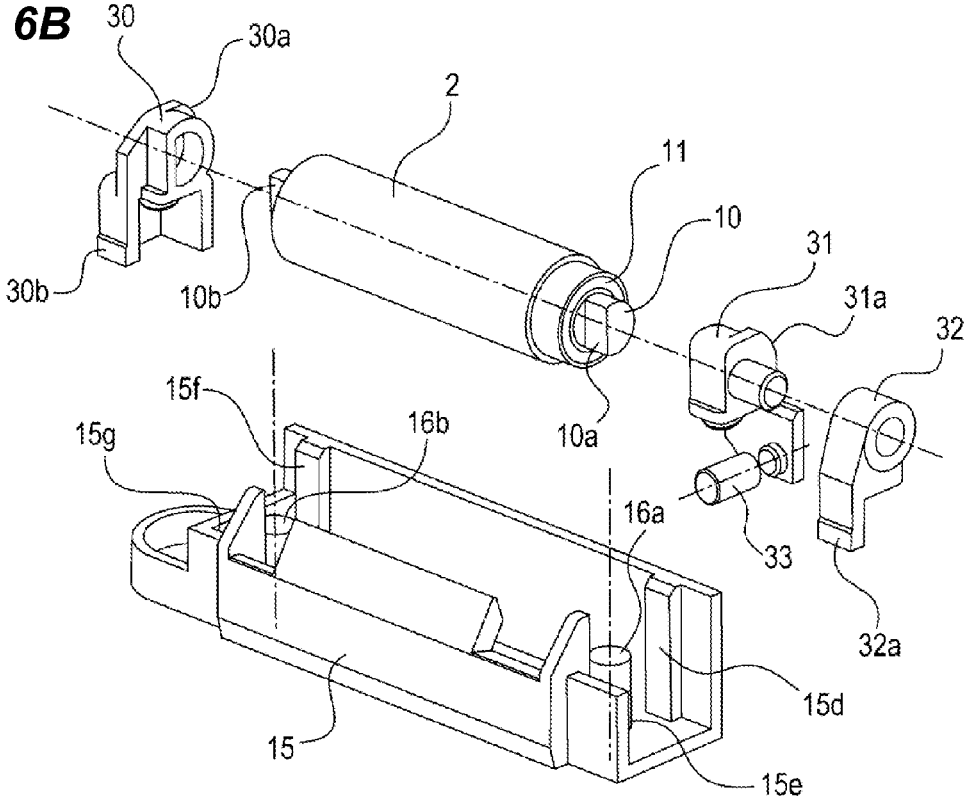

The configuration described in the present embodiment is applied without being limited to a type of swingingly pressing the separation roller 2, and may be also employed for a type of slidingly pressing the separation roller 2. FIGS. 6A and 6B illustrate examples in which a basic configuration of the present embodiment is applied to the feeding apparatus of the slide pressurization type. Furthermore, in a schematic configuration of the sheet feeding apparatus according to the third embodiment, the same components as those in the first embodiment are incorporated by the description of the first embodiment with the same reference numerals and will not be described.

A first bearing 30 and a second bearing 31 are fixed to the first shaft end and the second shaft end of the D-like cut portions 10*a* and 10*b*, which are provided on both ends of the separation roller shaft 10, respectively. A pressurization lever 32 is swingingly attached to the second bearing 31, and a pressurization spring 33 is incorporated between the second bearing 31 and the pressurization lever 32. The pressurization lever 32 and the pressurization spring 33 as an "addition portion" as the "deviation restraining portion" (separation portion) add a rotation force of a reverse direction relative to the rotation direction of the separation roller 2 to one end (at least one end) of a side, on which the second bearing 31 is provided in the separation roller shaft 10, through the second bearing 31 (one bearing).

The position of the first bearing 30 and the second bearing 31 are concurrently regulated by guide portions 15*d*, 15*e*, 15*f*, and 15*g* of the support body 15 provided in the sheet feeding apparatus. In addition, the pressing spring 16 applies a force to the first bearing 30 as a "first support member" toward the feeding roller 1 so as to slide, and then the separation roller 2 presses the feeding roller 1. The pressing spring 16 applies a force to the second bearing 31 as a "second support member" toward the feeding roller 1 so as to slide, and then the separation roller 2 presses the feeding roller 1.

Since the twist force does not act on the separation roller shaft 10 at the standby state, the force does not act between the sliding surface portions 30*a* and 30*b* of the first bearing 30 and the guide portions 15*f* and 15*g* of the support body 15. On the contrary, the force generated by the pressurization spring 33 acts between the sliding surface portion 31*a* of the second bearing 31 and the sliding surface portion 31*a* of the pressurization lever 21. Furthermore, the spring pressure of the pressurization spring 33 is set to be approximate one-half of the twist force acting around the separation roller shaft 10 by the separation torque generated by the torque limiter 11.

Meanwhile, since the separation torque generated by the torque limiter 11 acts on the separation roller shaft 10 during the feeding operation, two sliding surface portions 30*a* and 30*b* of the first bearing 30 presses two guide portions 15*f* and 15*g* of the separation base. At this time, since one-half of the separation torque is applied to the second bearing 31 by the action of the pressurization spring 33, the remaining one-half acts on the first bearing 30.

In a case of this configuration, sliding friction conditions of the right and left bearings 30 and 31 are different at the standby state. Accordingly, there is a possibility that the pressure balance of the nip of the separation roller 2 is deviated at the standby state, but the sliding friction conditions of the right and left bearings 30 and 31 become uniform at the state where the conveyance and separation of the sheets are performed, and thus the pressure balance of the nip of the separation roller 2 also becomes uniform. Since all existing problems are caused by the deviation of the pressure balance during the feeding operation, as described above, a uniformity of only the pressure balance during the feeding operation may be also considered as a way of solving the problems.

Furthermore, the present embodiment introduces the case where the pressurization spring 33 is incorporated inside the bearing, that is, a configuration in which the bearing thrusts out between the fixed guide surfaces for regulating the sliding, but the configuration may be in reverse. The first bearing 30 and the second bearing 31 may be configured using a normal bearing, and any one of the upstream guides 15*e* and 15*g* of the support body 15 may be in a movable type to incorporate the pressurization spring 33 in the guide surface; that is, the bearing having a fixed width may be sandwiched in the movable guide surfaces. The similar effect can be obtained even in this case.

Other Embodiments

The invention is not limited to the configurations according to the first to third embodiments. Even though the first support arm 12, the second support arm 13, the link member 14 are configured as a separate component in the first embodiment, for example, even when these components are configured as one component having an elastic deformation portion, the similar effect can be obtained.

In the first to third embodiments, the D-like cut portion is employed as a rotation locking portion of the separation roller shaft 10, but another fixing way using a parallel pin or a screw may be employed.

In the first to third embodiments, the separation roller 2 is employed as the sheet separation portion, but since the invention is applicable to the overall rotating member which generates the separation torque, a separation belt may be employed.

The case of slidingly pressing the separation roller 2 among the embodiments illustrates the configuration for regulating the sliding of the member corresponding to the bearings, which are attached to both ends of the separation roller shaft 10, by the guide surface of the sheet feeding apparatus. In the first embodiment, the sliding is regulated by the sliding surface portions of the first support arm 12 and the second support arm 13. However, the sliding of the separation roller shaft 10 itself may be regulated by the guide surface. In addition, the first shaft end of the second embodiment may be configured such that the separation roller shaft 10 is formed in an I-like shape and that the I-like shape is sandwiched in the guide surface of the support body 15. With this configuration, an outer diameter of the separation roller shaft 10 may be directly pressed by the pressing spring capable of regulating the sliding position with the rotation restraint.

According to each of the embodiments described above, it is possible to restrain the non-uniform phenomenon of the urging force, which applies a force of the separation roller 2 to the feeding roller 1, in the direction of the separation roller shaft 10.

The first support arm 12 and the second support arm 13, to which both ends of the separation roller 2 are fixed, and the "deviation restraining portion" that restrains the deviation of the torque generated in the direction of the separation roller shaft 10 acting on the separation roller 2 are provided. Thus, the non-uniformity of the pressing force, which occurs from the non-uniformity of the torque in the direction of the separation roller shaft 10 when the separation roller 2 is pressed against the feeding roller 1, significantly improved. Consequently, it can reduce the risk of the conveyance trouble, such as a skew of the sheet due to the difference in right and left of the conveyance resistance of the sheet, a lifetime shortening due to a partial wear or abnormal friction of the separation roller 2, a feeding delay due to a lack or an overplus of the pressing force, or a jamming of a multi-feeding, caused by the difference in right and left of the nip pressure of the separation roller 2.

According to the invention, it is possible to restrain the non-uniform phenomenon of the urging force that the separation portion applies a force to the feeding portion, in a direction of a rotation center shaft.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2012-268237, filed Dec. 7, 2012, which is hereby incorporated by reference herein in its entirety.

What is claimed is:

1. A sheet feeding apparatus comprising:

a stacking portion on which a sheet is stacked;

a feeding portion configured to feed the sheet stacked on the stacking portion;

a separation roller configured to separate the sheet fed by the feeding portion;

a shaft configured to support the separation roller;

a torque limiter configured to connect the shaft and the separation roller;

a supporting unit configured to support the shaft, wherein a rotation of the shaft with respect to the supporting unit is restricted, and the supporting unit includes a first supporting portion configured to support one end of the shaft, a second supporting portion configured to support an other end of the shaft, and a connecting portion configured to connect the first supporting portion and the second supporting portion;

a first abutting portion to which a first abutted portion provided on the first supporting portion abuts;

a second abutting portion to which a second abutted portion provided on the second supporting portion abuts; and a third abutting portion provided between the first abutting portion and the second abutting portion in the axial direction of the shaft, and to which a third abutted portion provided on the connecting portion abuts, the third abutting portion being positioned at an other side of the connecting portion from the first abutting portion and the second abutting portion.

2. The sheet feeding apparatus according to claim 1, wherein the torque limiter is provided on an end side of the shaft.

3. An image forming apparatus comprising:

an image forming portion which forms an image; and the sheet feeding apparatus according to claim 1.

4. The sheet feeding apparatus according to claim 1, wherein the third abutted portion is provided on central portion of the shaft in the axial direction.

5. The sheet feeding apparatus according to claim 1, further comprising an urging member configured to urge the supporting unit toward the feeding portion.

6. The sheet feeding apparatus according to claim 5, further comprising a support body configured to support an end of one side of the urging member, wherein the first abutting portion, the second abutting portion, and the third abutting portion are provided on the support body.

7. The sheet feeding apparatus according to claim 1, wherein the first abutting portion and the second abutting portion are provided downstream in a sheet feeding direction with respect to the shaft and the third abutting portion is provided upstream in the sheet feeding direction with respect to the shaft.

8. The sheet feeding apparatus according to claim 1, wherein the first abutting portion, the second abutting portion, and the third abutting portion restrain deviation of a torque acting from the shaft to the first supporting portion and a torque acting from the shaft to the second supporting portion.

9. The sheet feeding apparatus according to claim 1,wherein the first abutting portion restricts a position of the first supporting portion in a feeding direction and the second abutting portion restricts a position of the second supporting portion in the feeding direction.

* * * * *